US006889892B2

(12) United States Patent
Walsh et al.

(10) Patent No.: US 6,889,892 B2
(45) Date of Patent: May 10, 2005

(54) CONTAINER AND METHODS ASSOCIATED THEREWITH

(75) Inventors: Joseph C. Walsh, Boulder, CO (US); Robert L. Conatser, Longmont, CO (US); Raymond S. Kastanek, Longmont, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 326 days.

(21) Appl. No.: 10/053,732

(22) Filed: Jan. 18, 2002

(65) Prior Publication Data

US 2003/0136819 A1 Jul. 24, 2003

(51) Int. Cl.[7] ..... B65D 5/54; B65D 5/66; B65D 5/74

(52) U.S. Cl. ..... 229/117.31; 229/117.3; 229/123.3; 229/125.08; 229/125.15; 229/215; 229/229

(58) Field of Search ..... 229/117.3, 117.31, 229/117.34, 123.3, 125.04, 125.08, 125.09, 125.15, 215, 217, 229; 220/259.1, 259.2; 222/528, 531, 535, 541.5

(56) References Cited

U.S. PATENT DOCUMENTS

| | | | | | |
|---|---|---|---|---|---|
| 2,738,916 | A | * | 3/1956 | Peters | 229/125.05 |
| 2,778,557 | A | * | 1/1957 | Moore | 229/229 |
| 2,820,585 | A | | 1/1958 | Nerenberg et al. | |
| 3,127,082 | A | * | 3/1964 | Meyer-Jagenberg | 229/125.09 |
| 3,347,446 | A | | 10/1967 | Guyer et al. | |
| 3,426,955 | A | * | 2/1969 | Olson | 229/117.3 |
| 3,580,483 | A | | 5/1971 | Young | |
| 3,587,944 | A | * | 6/1971 | Pehr | 220/259.2 |
| 3,605,578 | A | | 9/1971 | Sternau | |
| 3,764,058 | A | | 10/1973 | Forbes, Jr. | |
| 4,411,365 | A | * | 10/1983 | Horikawa et al. | 229/117.31 |
| 4,565,315 | A | * | 1/1986 | Wagner et al. | 229/117.31 |
| 4,953,781 | A | * | 9/1990 | Bryan | 229/125.08 |
| 5,014,888 | A | * | 5/1991 | Bryan | 229/125.08 |
| 5,031,825 | A | | 7/1991 | Romagnoli | |
| 5,078,273 | A | | 1/1992 | Kuchenbecker | |
| 5,141,150 | A | * | 8/1992 | Plaessmann | 229/125.04 |
| 5,857,614 | A | | 1/1999 | Walsh | |
| 5,992,734 | A | * | 11/1999 | Tokarski et al. | 220/259.2 |
| 6,062,467 | A | | 5/2000 | Ours et al. | |
| 6,145,736 | A | | 11/2000 | Ours et al. | |
| 6,213,388 | B1 | | 4/2001 | Ours et al. | |
| 6,227,440 | B1 | | 5/2001 | Hart | |

FOREIGN PATENT DOCUMENTS

| | | |
|---|---|---|
| WO | WO 99/38779 | 8/1999 |
| WO | WO 00/74931 A1 | 12/2000 |

* cited by examiner

*Primary Examiner*—Gary E. Elkins
(74) *Attorney, Agent, or Firm*—Klaas, Law, O'Meara & Malkin, P.C.; Michael A. Goodwin

(57) ABSTRACT

Disclosed herein is a container defining an interior and an exterior provided with a first access panel and a second access panel for creating an opening for passage between the interior and the exterior, and methods for making and using such a container.

19 Claims, 13 Drawing Sheets

CONTAINER AND METHODS ASSOCIATED THEREWITH

FIELD

The disclosure herein is generally directed to a container having an opening for dispensing product from an interior to an exterior of the container and methods for using and making such a container.

BACKGROUND

Once primarily used to package the aggressive surfactants of concentrated detergents, laminate film containers are now used for numerous applications including soap boxes, cereal boxes, ice-cream boxes, can boxes, etc. Access to the products contained in such containers has been provided by a variety of means including so-called "bag-in-box" containers, access panel assemblies, tear strips, etc.

The components of such containers may generally include an inner layer and an outer layer. The outer layer serves as a support element, while the inner layer provides a barrier function. The inner layer may be a separate element, such as with a bag-in-box container, or adhered to the outer layer. These components are often made from recycled materials. In many cases, the outer layer is a Double-Kraft Lined (DKL) product. DKL paperboard consists of mixed fibers in the inner plies with one ply of Kraft on either side for strength. Typically, the inner layer is a plastic such as polyethylene (PE), polypropylene (PP), or polyethylene terephthalate (PET). An optional metalization layer may be deposited on the inner layer to further increase the barrier properties of the inner layer. The metalization layer may be provided on a surface of the inner layer by vapor deposition and is often an aluminum layer.

Containers, such as those described above, may be formed from blanks that are separated from a web of material. After being separated from the web of material, such blanks may be inserted into a separate machine or in-line section of a continuous machine for gluing and folding (often referred to as a folder/gluer machine). While traveling through the folder/gluer machine, the blanks may receive adhesive and then be folded into containers.

SUMMARY

In one embodiment disclosed herein, a container may include: an outer layer of a relatively rigid material; an inner layer of a relatively flexible fluid impervious material, at least a portion thereof attached to the outer layer; a first access panel defined by at least one fold line and a plurality of cut lines provided on the outer layer; and a second access panel encapsulated between the outer layer and the inner layer; wherein at least a portion of the second access panel is attached to the inner layer; and wherein at least a portion of the second access panel is adjacent to the first panel.

In another embodiment disclosed herein, the a container may define an interior portion and an exterior portion, the container including: a first access panel hingedly attached to the container and adjacent to the exterior portion; a second access panel hingedly attached to the container and adjacent to the interior portion; and wherein the first access panel is adjacent to the second access panel.

In another embodiment disclosed herein, a method of dispensing a product from a container defining an interior portion and an exterior portion may include: pivoting a first access panel hingedly attached to the container about a first axis; disrupting an inner layer, thereby exposing the interior portion to the exterior portion; pivoting a second access panel hingedly attached to the container about a second axis, thereby creating an opening between the exterior portion and the interior portion; and dispensing the product from the container interior portion to the container exterior portion through the opening.

In another embodiment disclosed herein, a method of manufacturing a container blank for a sealed container, the method may include: providing a relatively rigid material in a web comprising: a plurality of container panels including a first container panel formed by a plurality of fold and cut lines; a first access panel formed in the first container panel; providing a second access panel comprising: a first portion; and a second portion; adhering the second access panel first portion to the first access panel; providing a relatively flexible fluid impervious material comprising: a first portion; and a second portion; adhering the relatively flexible fluid impervious material first portion to the first container panel; covering the second access panel second portion with the relatively flexible fluid impervious material second portion; and separating the container blank from the web.

In another embodiment disclosed herein, a container defining an interior portion and an exterior portion, the container may include: a first container panel comprising an inside and an outside; a first access panel hingedly attached to the first container panel about a first axis; a second access panel hingedly attached to the first container panel about a second axis, wherein the second axis is substantially parallel to the first axis; a first operating condition wherein: the first access panel and the second access panel are coplanar with the first container panel; a second operating condition wherein: the first access panel is not coplanar with the first container panel, and the second access panel is coplanar with the first container panel, a third operating condition wherein: the second access panel is not coplanar with the first container panel, and the second access panel is coplanar with the first access panel.

BRIEF DESCRIPTION OF THE DRAWINGS

Illustrative and presently preferred embodiments are illustrated in the drawings in which.

DESCRIPTION

Figure 1:
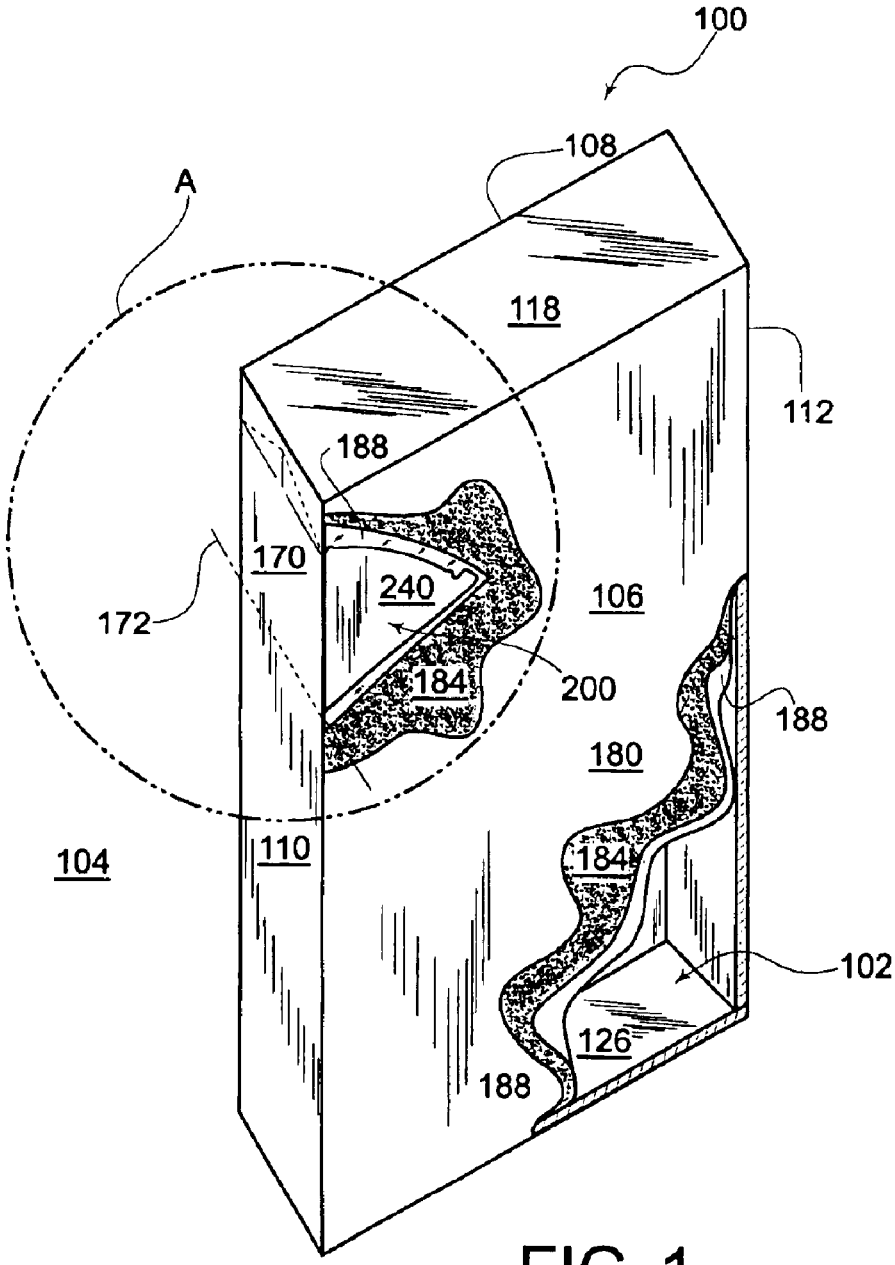
FIG. 1 shows a perspective view of a container having portions thereof removed to show an internal portion and layers associated therewith.
Figure 2:
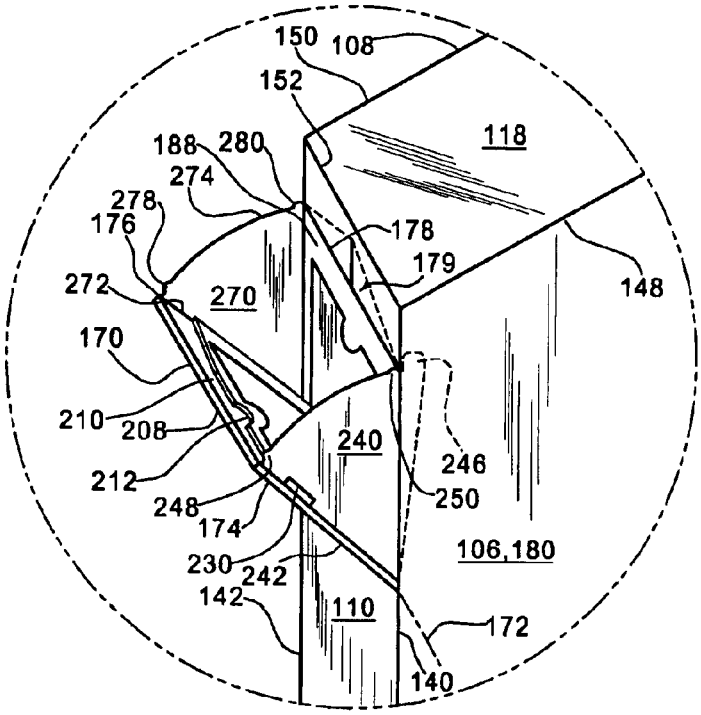
FIG. 2 shows a perspective view of an enlarged portion, denoted by detail A in FIG. 1, of the container of FIG. 1 having an opening between the internal portion and an external portion.
Figure 3:
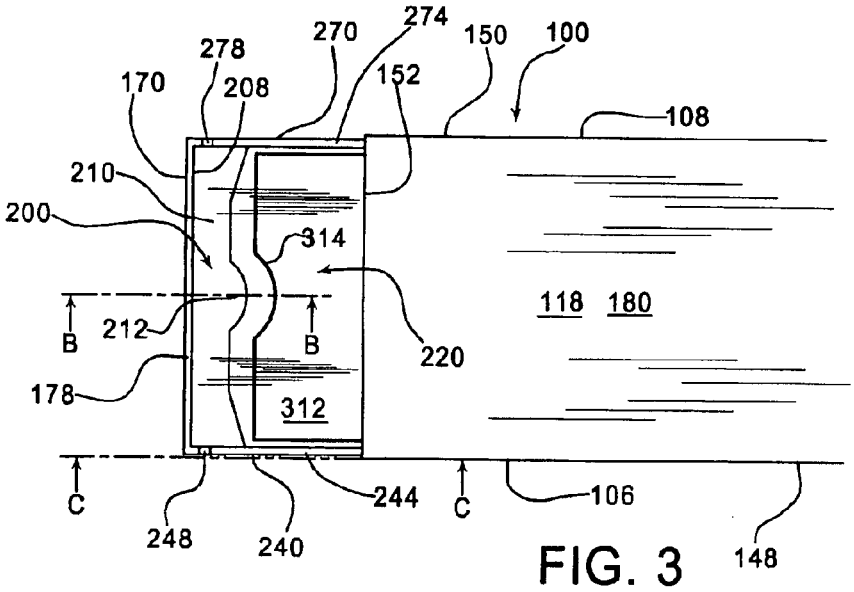
FIG. 3 shows a top plan view of the enlarged portion, denoted by detail A in FIG. 1, of the container of FIG. 1.

With reference to FIG. 1, an exemplary container 100 is shown having portions thereof broken-away in a manner described later herein. The exemplary container 100 is shown with an opening, sometimes referred to herein as an access panel assembly 200. As shown in FIG. 2, the open access panel assembly 200 allows for passage of product from a container interior 102 to a container exterior 104.

Figure 4:
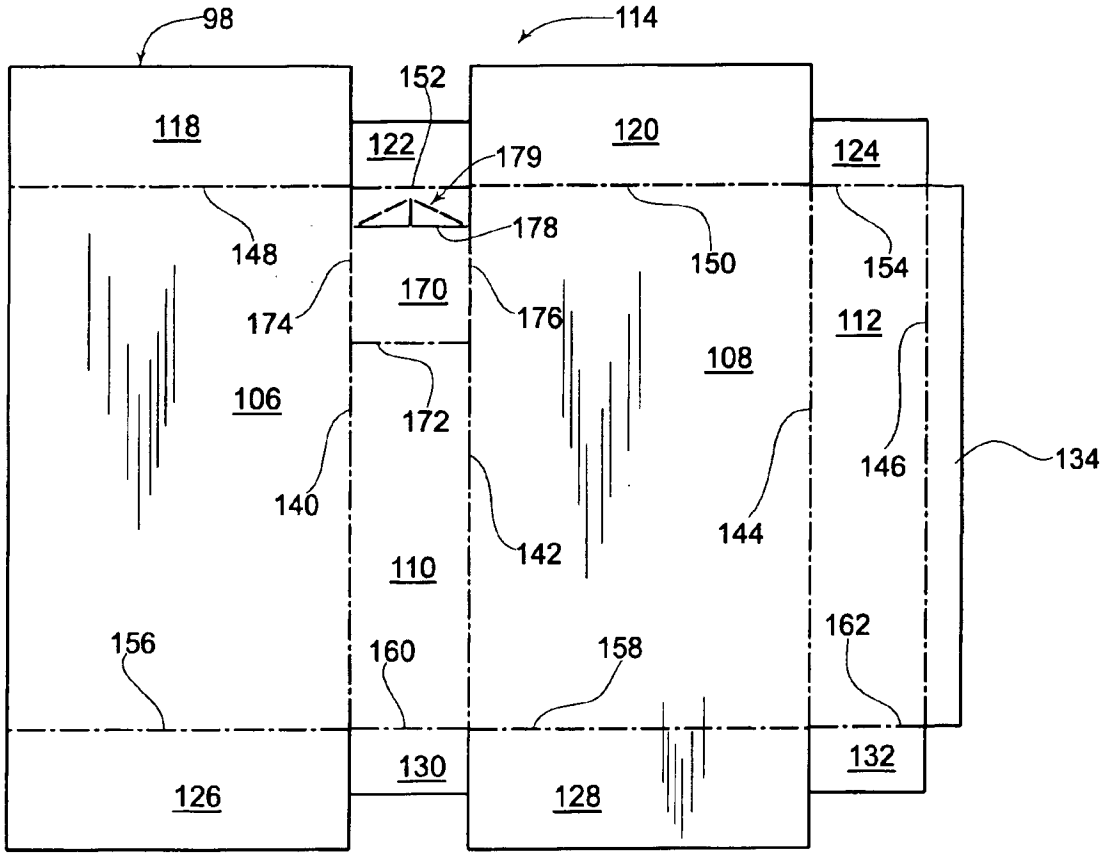
FIG. 4 shows a top plan view of a blank, from which a container may be erected.

With reference to FIG. 4, a blank 98, from which the container 100 may be erected, may be provided with a variety of panels, formed by a plurality of fold lines and cut lines. The exemplary blank 98 may be provided with a front portion 106, a back portion 108, a first sidewall portion 110, a second sidewall portion 112, a top portion 114 and a bottom portion 116. The top portion 114 may be provided with a front top portion 118, a back top portion 120, a top first sidewall portion 122 and a top second sidewall portion 124. The bottom portion 116 may be provided with a bottom front portion 126, a bottom back portion 128, a bottom first sidewall portion 130 and a bottom second sidewall portion 132. Furthermore, the container 100 may be provided with a sidewall glue flap 134.

With further reference to FIG. 4, the panels may be separated by fold lines such as a front fold line 140, a first sidewall fold line 142, a back fold line 144 and a glue flap fold line 146. Additional fold lines may be provided such as a top front fold line 148, a top back fold line 150, a first sidewall fold line 152 and a second sidewall fold line 154. The container 100 may be further provided with a bottom front fold line 156, a bottom back fold line 158, a bottom first sidewall fold line 160 and a bottom second sidewall fold line 162. The first sidewall portion 110 may be provided with a first access panel 170, defined by a fold line 172, a first side cut line 174, a second side cut line 176 and a top cut line 178. The first side cut line 174, the second side cut line 176 and the top cut line 178 may have nicks provided therein for retaining the position of the first access panel 170. These nicks may be portions of the outer layer 180 that are not disrupted while making the cut lines 174, 176 and 178.

As best shown in FIG. 2, the first sidewall portion 110 may be provided with an opening initiator 179. Opening initiator 179 may, for example, be of the type disclosed in U.S. Pat. No. 5,857,614 titled CARTON BLANK AND CARTON FORMED THEREFROM of Joseph C. Walsh issued on Jan. 12, 1999, which is hereby incorporated by reference for all that is disclosed therein. Other varieties of opening initiators may alternatively be used, such as tear strips, as those skilled in the art will appreciate upon reading the present disclosure.

Figure 22:
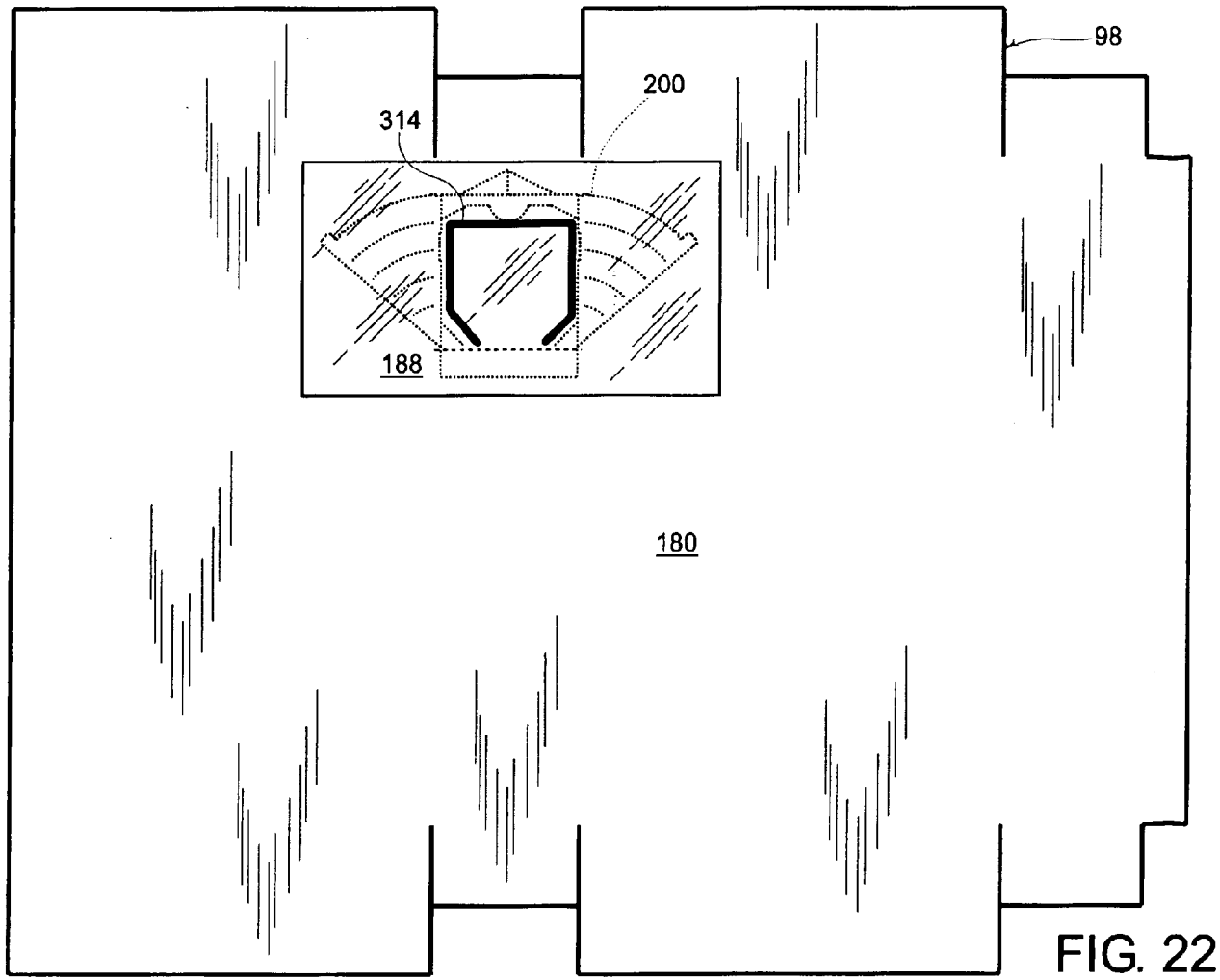
FIG. 22 shows a top plan view of a blank provided with an inner layer.

With reference to FIG. 1, the broken-away portion of the container 100 shows layers that may be provided such as an outer layer 180, an adhesive layer 184 and an inner layer 188. Although various embodiments and applications have been contemplated, the embodiment shown in FIGS. 1–8 shows a container 100 having its entire profile covered with the inner layer 188. It is noted that such exemplary configuration of the inner layer 188 is provided for descriptive purposes only and that the inner layer 188 may cover any portion of the outer layer 180 (e.g. as shown in FIG. 22).

The outer layer 180 may be composed of any one of a number of materials which are relatively rigid such as paperboard, clay-coated paperboard, Kraft lined paperboard, double Kraft lined paperboard, or their equivalents now known to those skilled in the art or which are later developed. One exemplary outer layer 180 is clay-coated paperboard which is readily printable, economical and environmentally acceptable.

The adhesive layer 184 may be any of a number of adhesives which are capable of adhering one layer to another layer (e.g. the outer layer 180 to the inner layer 188). The adhesive layer 184 may be formed from any type of adhesive material, such as hot adhesive (e.g. ethyl vinyl acetate, hot melt adhesive, spray melt adhesive, etc.), cold adhesive (e.g. starch adhesive, pressure sensitive adhesive, adhesives dissolved in volatile carriers, etc.) or other adhesives which are now known to those skilled in the art or which are later developed.

The inner layer 188 may be composed of a number of materials which are relatively flexible and relatively fluid impervious. The inner layer 188 may comprise plastics such as polyethylene, polypropylene, polystyrene, poly vinyl chloride, or their equivalents now know to those skilled in the art or which are later developed.

Figure 5:
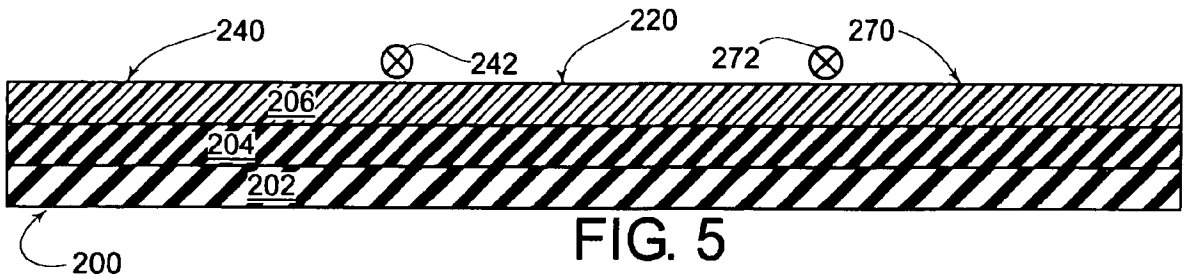
FIG. 5 shows a cross sectional side elevation of an access panel assembly taken across plane 5—5 in FIG. 6.

With reference to FIG. 5, the access panel assembly 200 may be composed of any of a number of materials capable of providing the functionality desired for this particular configuration. In one non-limiting, exemplary embodiment, the access panel assembly 200 may be fabricated from a material having a plurality of layers. The access panel assembly 200 may be provided with a layer of a relatively rigid material 202 (e.g., paperboard), a heat barrier layer 204 (e.g., metal) and a heat bondable layer 206 (e.g., polyethylene). The heat barrier layer 204 may be any one of a number of materials capable of tolerating temperatures higher than the melting temperature of the heat bondable layer 206. Other combinations of materials for the access panel assembly 200 may be utilized as those skilled in the art may appreciate, upon reading the present disclosure.

Figure 6:
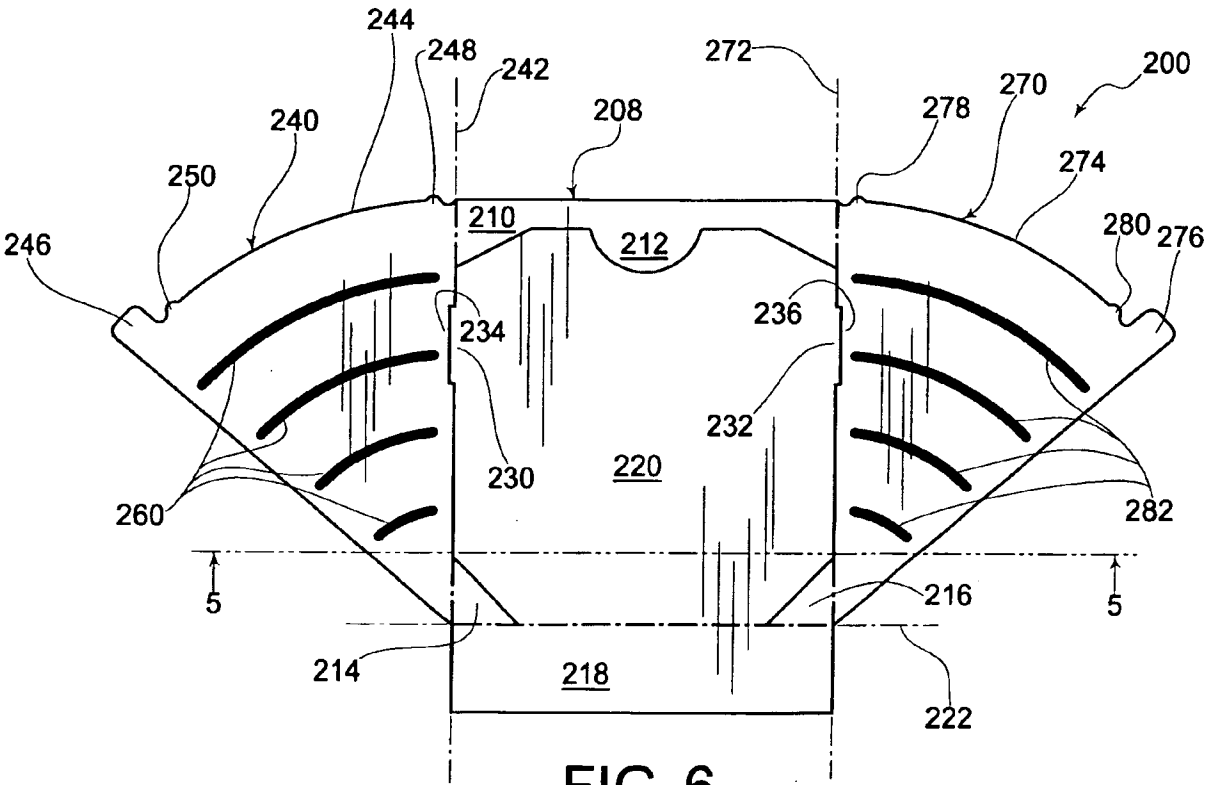
FIG. 6 shows a top plan view of the access panel assembly of FIG. 5.

With reference to FIG. 6, the access panel assembly 200 may be provided with a center portion 208. The center portion 208 may be provided with a top attached portion 210, a finger tab 212, a bottom first attached portion 214, a bottom second attached portion 216, a bottom third attached portion 218 and an inner layer carrier 220. The inner layer carrier 220 may also be referred to herein as a second access panel 220. The inner layer carrier 220 may be hingedly attached to the third attached portion 218 about a panel fold line 222. The access panel assembly 200 may be provided with a catch. One example of such a catch may be a first tab 230 and a second tab 232. In this exemplary embodiment, the first and second tabs 230, 232 may interact with a first recess 234 and a second recess 236, respectively, for securing the inner layer carrier 220 to the first wing 240 and the second wing 270, in a manner described later herein.

With further reference to FIG. 6, the access panel assembly 200 may be further provided with a first wing 240 pivotally attached to the center portion 208 about a first wing fold line 242. The first wing 240 may be provided with a top edge 244, having a generally arcuate profile. The first wing 240 may be further provided with a stop 246 for limiting the range of motion of the access panel assembly 200. The first wing 240 may be further provided with catches for holding the access panel assembly 200 at predetermined locations (e.g. a closed position and an open position). A closed catch 248 and an open catch 250 may be provided on the first wing 240. Additionally, the first wing 240 may be provided with stiffening features, such as raised portions 260 for increasing the first wing's resistance to bending forces.

With further reference to FIG. 6, the access panel assembly 200 may be further provided with a second wing 270 pivotally attached to the center portion 208 about a second wing fold line 272. The second wing 270 may be provided with a top edge 274, having a generally arcuate profile. The second wing 270 may be further provided with a stop 276 for limiting the range of motion of the access panel assembly 200. The second wing 270 may be further provided with catches for holding the access panel assembly 200 at predetermined locations (e.g. a closed position and an open position). A closed catch 278 and an open catch 280 may be provided on the second wing 270. Additionally, the second wing 270 may be provided with stiffening features, such as raised portions 282, for increasing the first wing's resistance to bending forces.

Figure 7:
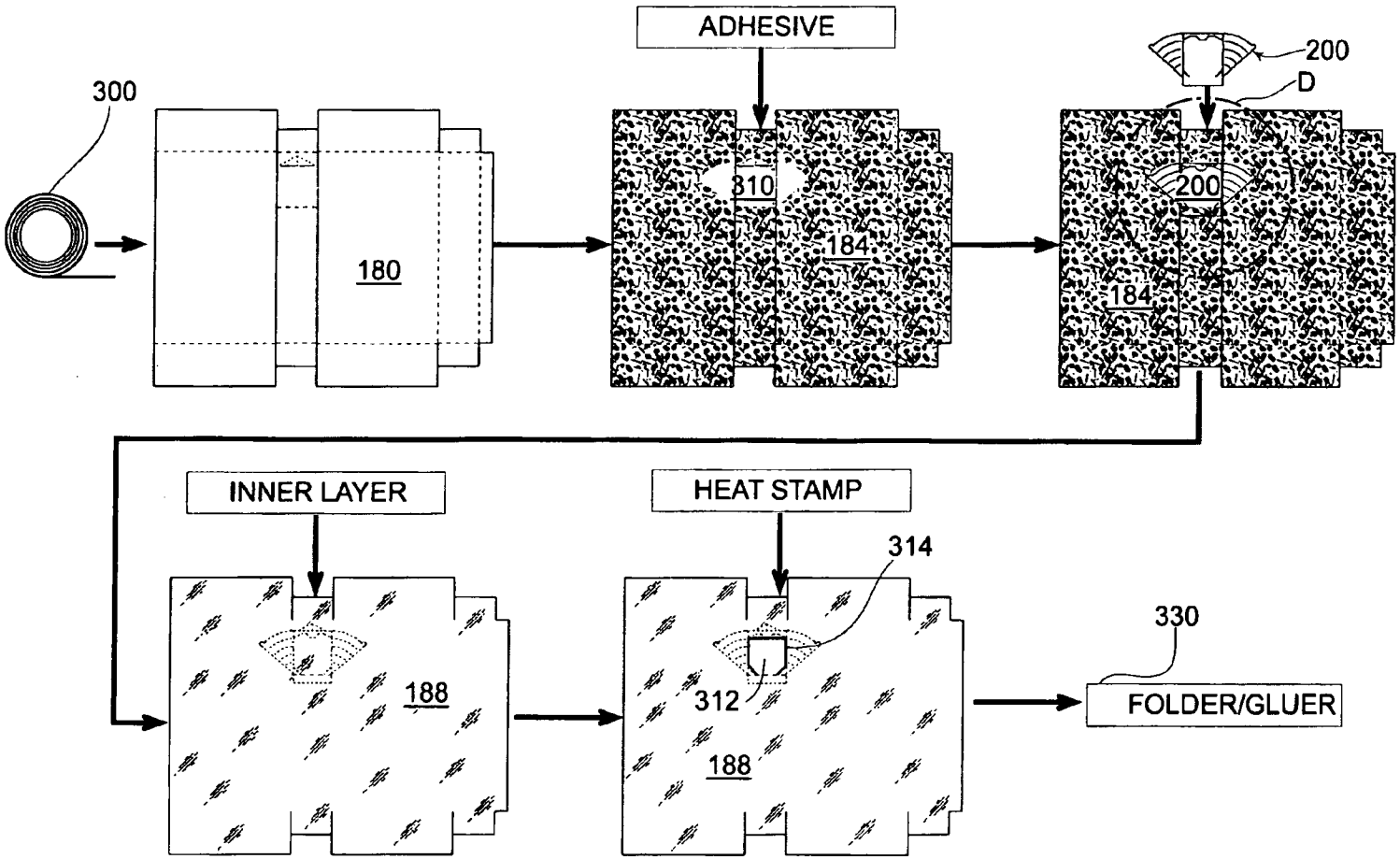
FIG. 7 shows a schematic of an exemplary manufacturing process for making blanks such as the blank shown in FIG. 4.

An exemplary process of manufacturing the blank 98, FIG. 4, from which the carrier 100 may be erected is shown schematically in FIG. 7. With reference to FIG. 7, a web of material 300 may be processed to provide the outer layer 180 of the blank 98 in conventional processing equipment. This conventional processing equipment may perform processes such as printing, cutting, scoring, etc. Examples of such processing steps are described in U.S. patent application Ser. No. 09/864,567 for a CARTON BLANK AND METHOD OF FORMING A CARTON of Joseph C. Walsh filed on May 24, 2001, which is hereby incorporated by reference for all that is disclosed therein.

The outer layer 180 may have an adhesive applied thereto to create the adhesive layer 184. The adhesive layer 184 may be applied to the outer layer 180 in all areas except an adhesive-free area 310 (refer to FIG. 8 for an enlarged view of the adhesive-free area 310). Such an application of adhesive may be provided by a gravure roll or other application methods now well known to those skilled in the art or by processes later developed that yield equivalent results.

Figure 8:
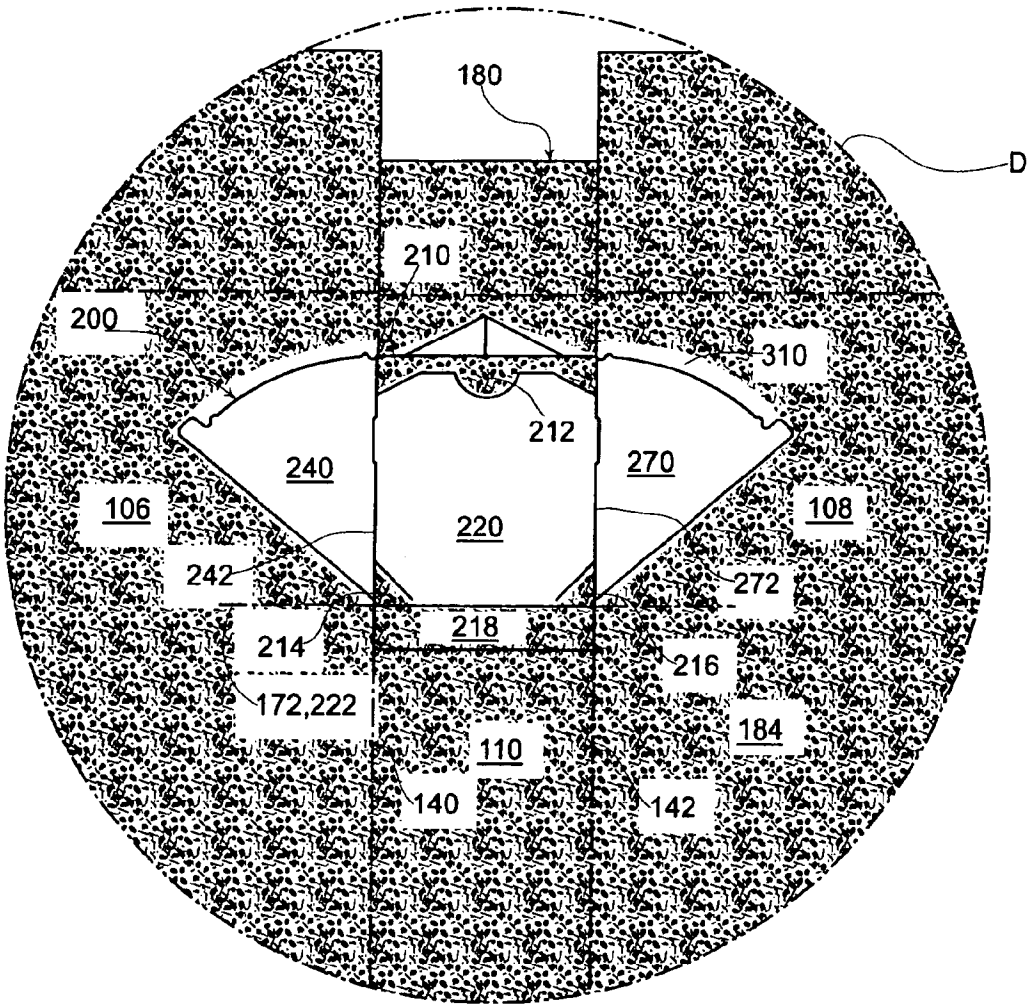
FIG. 8 shows a top plan view of an enlarged portion, denoted by detail D in FIG. 7, of a blank provided with a portion of an access panel assembly adhered thereto.

With further reference to FIG. 7, after applying the adhesive layer 184, the access panel assembly 200 may be adhesively attached to the outer layer 180 by the adhesive layer 184. With reference to FIG. 8, such adhesion of the access panel assembly 200 to the outer layer 180 may result in the bottom third attached portion 218 being attached to the first sidewall portion 110. Additionally, the bottom first attached portion 214, the bottom second attached portion 216 and the top attached portion 210 may be adhesively attached to the first access panel 170 (FIG. 4). The first access panel fold line 172 may be adjacent and/or parallel to, the access panel assembly panel fold line 222. Adhesion of the access panel assembly 200 may result in the access panel assembly relatively rigid material 202 (FIG. 5) being adhesively attached adjacent to the container inside portion 102 of the carton blank outer layer 180 (FIG. 1). Furthermore, the first wing 240 may be adjacent to the front panel 106 with the first wing fold line 242 adjacent to, and parallel to, the front fold line 140. The second wing 270 may be adjacent to the back panel 108 having the second wing fold line 272 adjacent to, and parallel to, the first sidewall fold line 142. The first and second wings 240, 270 are not adhesively attached to the outer layer 180 because they overlay a portion of the adhesive-free area 310 (accordingly, the first and second wings 240, 270 may slide against the outer layer 180). Additionally, the inner layer carrier 220 is not adhesively attached to the first access panel 170.

With further reference to FIG. 7, after adhesively joining the access panel assembly 200 to the outer layer 180, the inner layer 188 may be adhesively attached to the outer layer 180. Such adhesive attachment of the inner layer 188 to the outer layer 180, by the adhesive layer 184, may cover the entire blank 98, or alternatively, only a portion of the blank 98. In the use where that the inner layer 188 covers the entire blank 98, the inner layer 188 may provide a sealing layer between the container's interior 102 and the container's exterior 104, when the container 100 is fully erected.

With further reference to FIG. 7, as a further step in the processing of the container blank 98, the inner layer 188 may be frangibly attached to the access panel assembly 200. In one exemplary embodiment, the inner layer 188 may have an attached portion 312 attached to the inner layer carrier 220 (FIG. 6). Such attachment may be provided by a number of methods. An example of one such attachment method is the attachment of the inner layer 188 to the access panel assembly inner layer carrier 220 by a heat stamping device.

Figure 9:
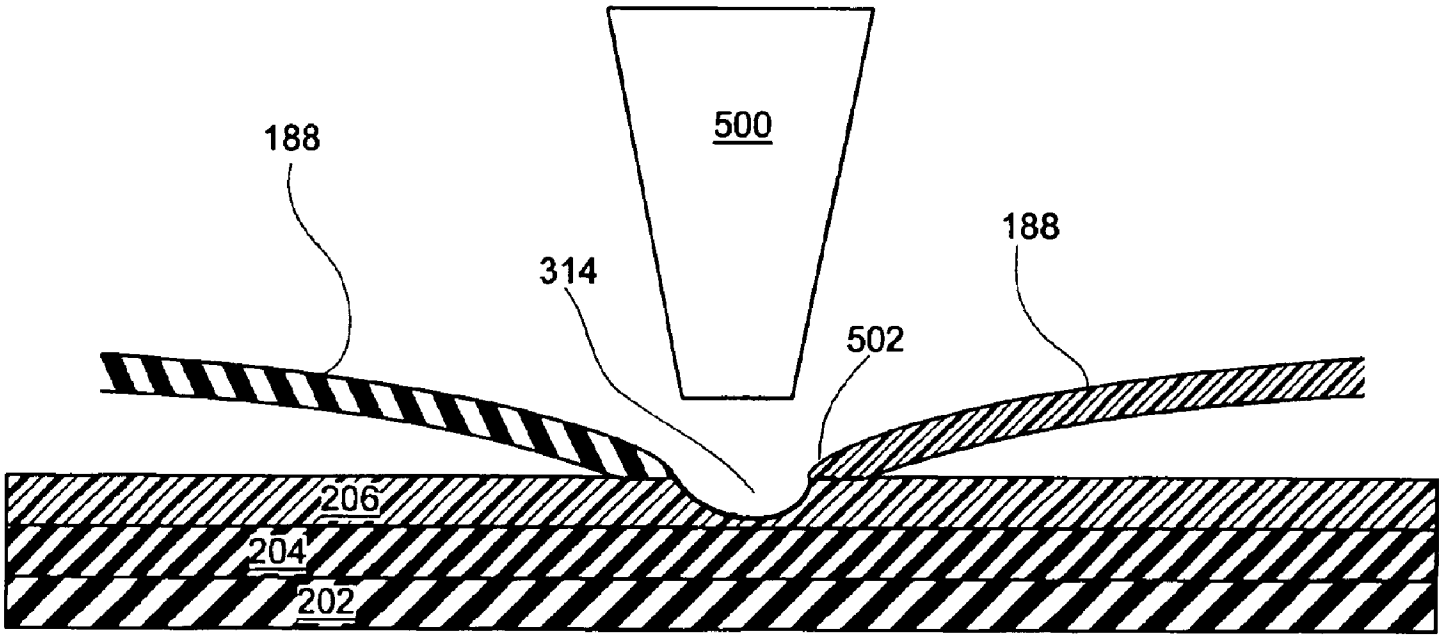
FIG. 9 shows a cross sectional side elevation of an access panel assembly frangibly adhered with a heat stamping device.

With reference to FIG. 9, if provided, a heat stamping device 500 applies heat and pressure to the inner layer 188, thereby compressing the inner layer 188 between the heat stamping device 500 and the access panel assembly heat bondable layer 206. The compression forces and heat serve to bond the inner layer 188 to the heat bondable layer 206 at a bonded line 314. The bond line 314 may have a frangible portion 502 associated therewith. This frangible portion 502 serves to allow access to the container interior 102, in a manner that will be described later herein. Exemplary ways to attach an inner layer to an opening panel are disclosed, for example, in U.S. patent application Ser. No. 10/027,744 of Joseph C. Walsh titled CARTON BLANK AND CARTON FORMED THEREFROM filed on Dec. 20, 2001, which is hereby specifically incorporated by reference for all that is disclosed therein. Utilization of a heat stamping device is considered to be an exemplary manufacturing process, and other methods for frangibly attaching the inner layer 188 to the access panel assembly 200 have been contemplated; a few of these alternative embodiments will be described later herein (e.g. FIG. 21).

With reference to FIG. 7, after frangibly attaching the inner layer 188 to the access panel assembly 200, the blank 98 may be separated from the web 300. The separated blank 98 may be erected into a container 100 by any of a variety of processes such as a folder/gluer 330, FIG. 7. An exemplary type of folder/gluer is described in detail in U.S. patent application Ser. No. 09/877,336 of Joseph C. Walsh et al. titled TRANSFER GLUE SYSTEM AND METHOD FOR A RIGHT ANGLE GLUING MACHINE filed on Jun. 8, 2001 which is hereby incorporated by reference for all that is disclosed therein. After erecting the container 100, a product may be dispensed into the container interior 102 and the container 100 sealed. After sealing the container 100, the container 100 and product contained therein may be distributed to the ultimate end user of the container.

Having described the exemplary construction and exemplary elements of the container 100 of FIGS. 1–9, the process of using such a device will now be described.

Figure 12:
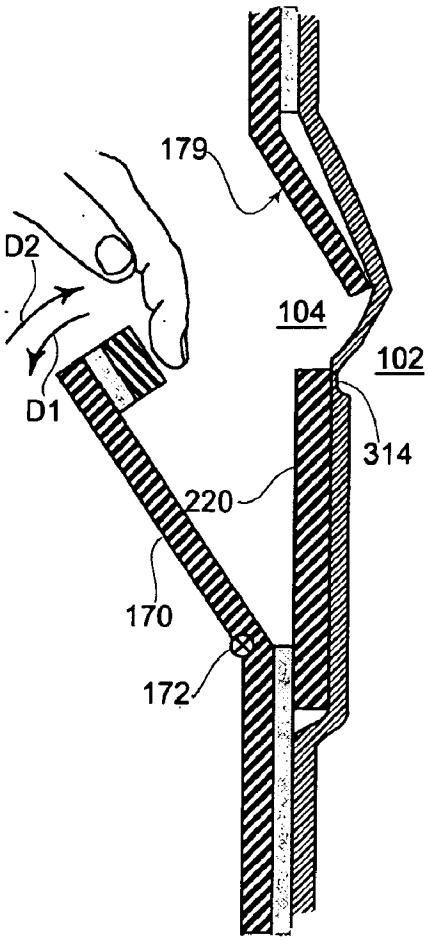
FIG. 12 shows a cross sectional side elevation view taken across plane B—B in FIG. 3 of the container of FIG. 1 in another condition.
Figure 11:
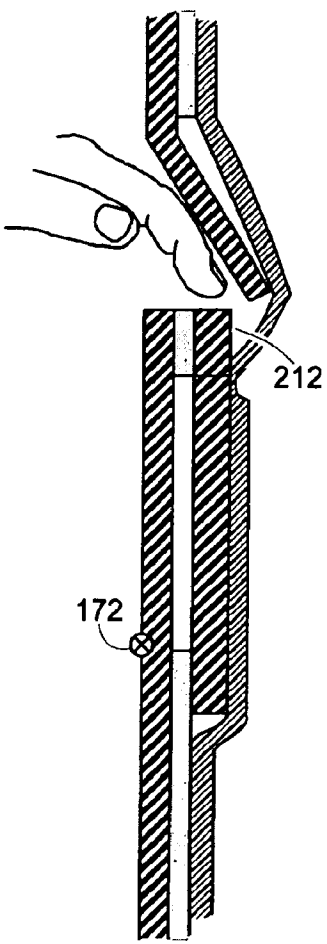
FIG. 11 shows a cross sectional side elevation view taken across plane B—B in FIG. 3 of the container of FIG. 1 in another condition.

The process of opening the container 100 having a first access panel 170 and a second access panel 220 is shown in FIGS. 10–13. It is noted again that the second access panel 220 is also referred to herein as the inner layer carrier 200. The process of opening the container 100 commences by placing a finger through the opening initiator 179, FIG. 10, and then behind the first access panel 170, in the center portion 208, near the finger tab 212, as shown in FIG. 11. With reference to FIG. 12, after placing the finger on the finger tab 212, the user may pull on the first access panel 170 in an outward direction D1. By pulling the first access panel 170, the user causes the nicks formed in the first side cut line 174 and the second side cut line 176 to break (FIG. 4). After breaking the nicks that hold the first access panel 170 coplanar to the first sidewall portion 110, the first access panel 170 may hinge about the fold line 172 in the outward direction D1. As the fist access panel 170 rotates about the fold line 172, any elements operatively associated therewith also rotate. In one exemplary embodiment, the first access panel 170 may be provided with the first wing 240 and the second wing 270, which are operatively associated therewith, that rotate with the first access panel 170 as shown in FIGS. 2 and 14–16.

Figures 14, 15, 16:
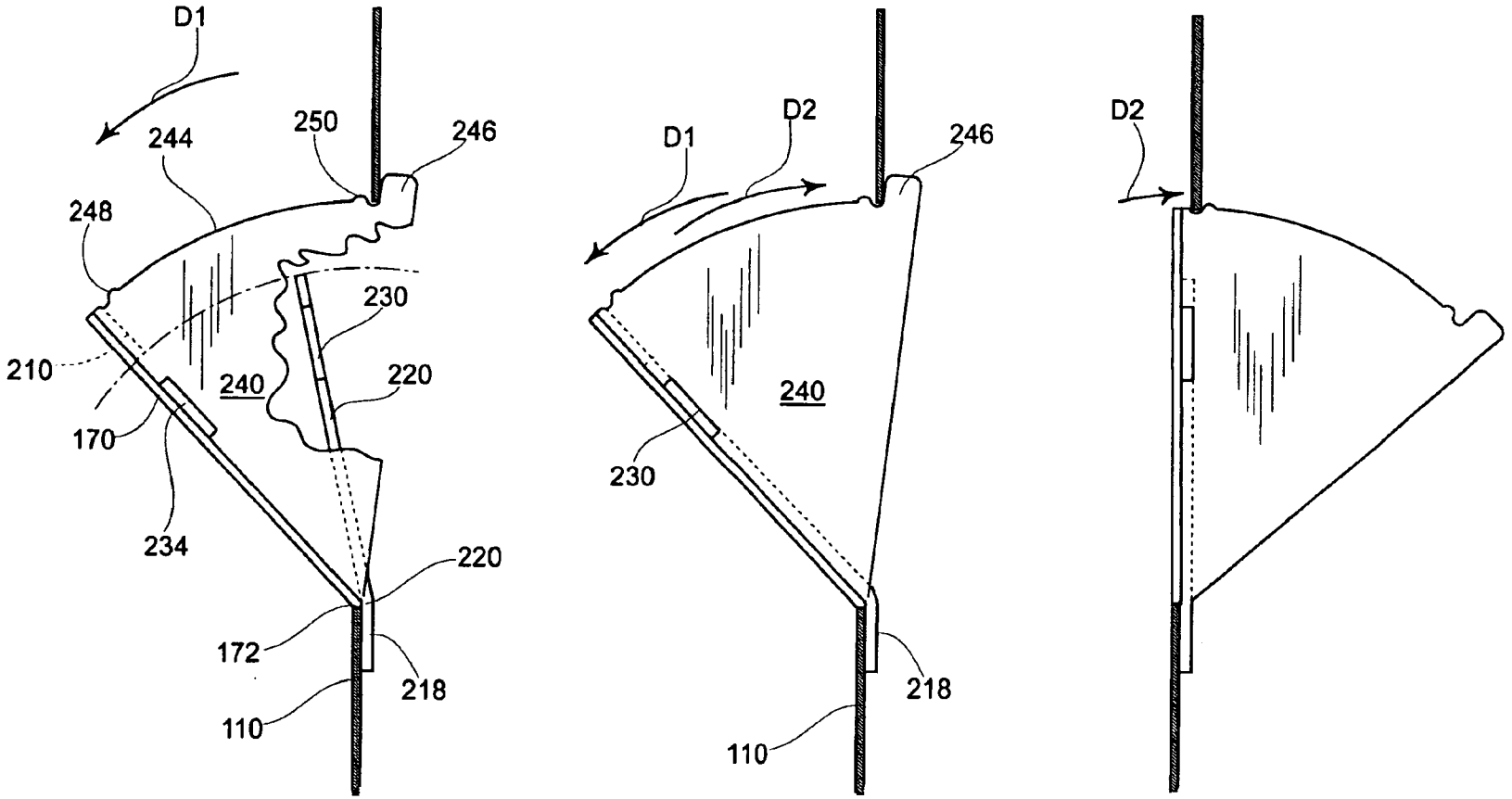
FIG. 14 shows a cross sectional side elevation view taken across plane C—C in FIG. 3 of the container of FIG. 1 in the condition illustrated in FIG. 13.
FIG. 15 shows a cross sectional side elevation view taken across plane C—C in FIG. 3 of the container of FIG. 1 in a fully open condition.
FIG. 16 shows a cross sectional side elevation view taken across plane C—C in FIG. 3 of a container of FIG. 1 in a re-closed condition.

With reference to FIG. 14, this rotation of the first access panel 170 may continue until the stops 246, 276 contact the first sidewall portion 110. At the point that rotation of the first access panel 170 terminates due to the contact of the stops 246, 276, the open catches 250, 280 'snap' over the first sidewall portion 110 to hold the first access panel 170 in an open position.

Figure 13:
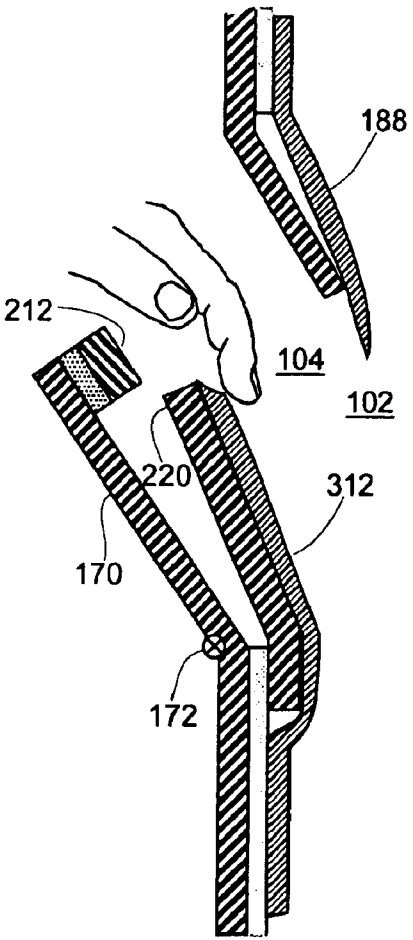
FIG. 13 shows a cross sectional side elevation view taken across plane B—B in FIG. 3 of the container of FIG. 1 in another condition.

With reference to FIG. 13, after opening the first access panel 170, the user may push a finger through the inner layer 188 to rupture the seal between the container interior 102 and the container exterior 104. By rupturing the inner layer 188, the user has initiated separation of the inner layer attached portion 312 from the remaining inner layer 188. Such separation may occur at the frangible portion of the bonding line 314 (FIG. 10) near the finger tab 212. The user then places the finger into the container interior 102, adjacent to the inner layer 188 on the inner layer carrier 220. After locating the finger on the container interior portion of the inner layer carrier 220, the user may move the inner layer carrier 220 in the outward direction D1. Moving the inner layer carrier 220 in the outward direction D1 may cause further separation of the inner layer attached portion 312 from the remaining inner layer 188 at the bonding line 314. Rotation of the inner layer carrier 220 in the outward direction D1 may continue until the inner layer carrier 220 contacts the first access panel 170.

It is noted that this action of opening the first access panel 170 and inner layer carrier 220 occurs in a dual-stage process rather than a single-stage process. During the first stage of this dual-stage opening, the first access panel 170 is partially severed from the first sidewall portion 110. During the second stage of this dual-stage opening, the inner layer carrier 220 is partially severed from the remaining access panel assembly 200. Such dual-stage opening of the container 100 results in an opening process wherein the forces required to open the container 100 are spread over a longer period of time. By spreading the opening forces over a longer period of time, each individual opening force is reduced. Furthermore, a user may readily witness the disruption of the inner layer 188 while opening the inner layer carrier 220. Such disruption of the inner layer 188 may make the barrier function of the inner layer 188 more identifiable to the user when compared to a single-stage opening.

If a catch mechanism, such as tabs 230, 232, is provided with the present apparatus, the inner layer carrier 220 may 'click' into position adjacent to the first access panel 170 by a process shown in FIGS. 14–16. FIGS. 14–16 show a view of the container 100 taken across plane C—C in FIG. 3. FIG. 14 shows a partially broken-away view of the first access panel 170 in the open position while the second access panel 220 (also referred to as the inner layer carrier 220) rotates in the outward direction D1. As the inner layer carrier 220 rotates, the first tab 230 slides against the first wing 240. At the point of rotation where the inner layer carrier 220 contacts the first access panel 170, the first tab 230 'clicks' into position with the first recess 234 as shown in FIG. 15. Likewise, at the extent of rotation of the inner layer carrier 220 in the outward direction D1, the second tab 232 'clicks' into position with the second recess 236 (all of which are shown in FIG. 6). The two tabs 230, 232 serve to hold the inner layer carrier 220 adjacent to, and rotationally associated with, the first access panel 170. With the inner layer carrier 220 adjacent to and rotationally associated with the first access panel 170, movement of the first access panel 170 causes the same movement of the inner layer carrier 220. Therefore, when the first access panel 170 is moved in an inward direction D2, the first access panel 170 rotates about the fold line 172. With reference to FIG. 16, at the extent of rotation of the first access panel 170 in the inward direction D2, the closed stops 248, 278 'snap' into contact with the first sidewall portion 110 to hold the first access panel 170 coplanar with the first sidewall panel 110.

With reference to FIGS. 15 and 16, after the initial opening of the container 100, the first access panel 110 and the inner layer carrier 220 are joined, thereby resulting in synchronized movement. As such, when the first access panel 110 is opened, the inner layer carrier 220 is also opened. This opened condition results in the ability to transfer product from the container interior 102 to the container exterior 104. Passage of product from the container interior 102 to the container exterior 104 in the exemplary container 100 shown in FIG. 1 may occur by tilting the container 100 such that the access panel assembly 200 is lower then the product contained therein.

Figure 10:
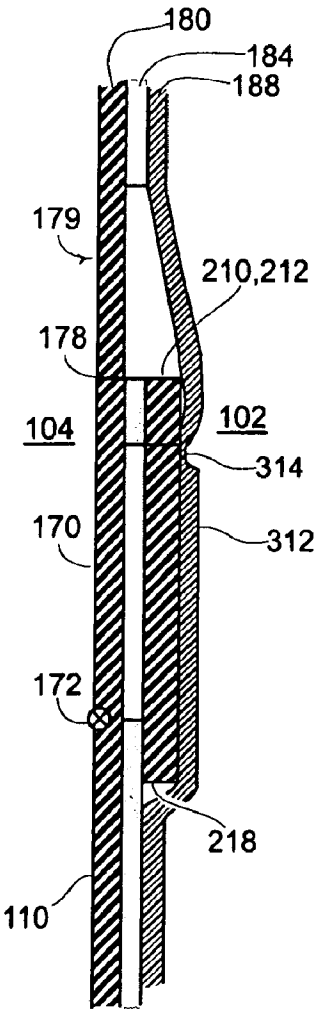
FIG. 10 shows a cross sectional side elevation view taken across plane B—B in FIG. 3 of the container of FIG. 1 in a first condition.
Figure 17:
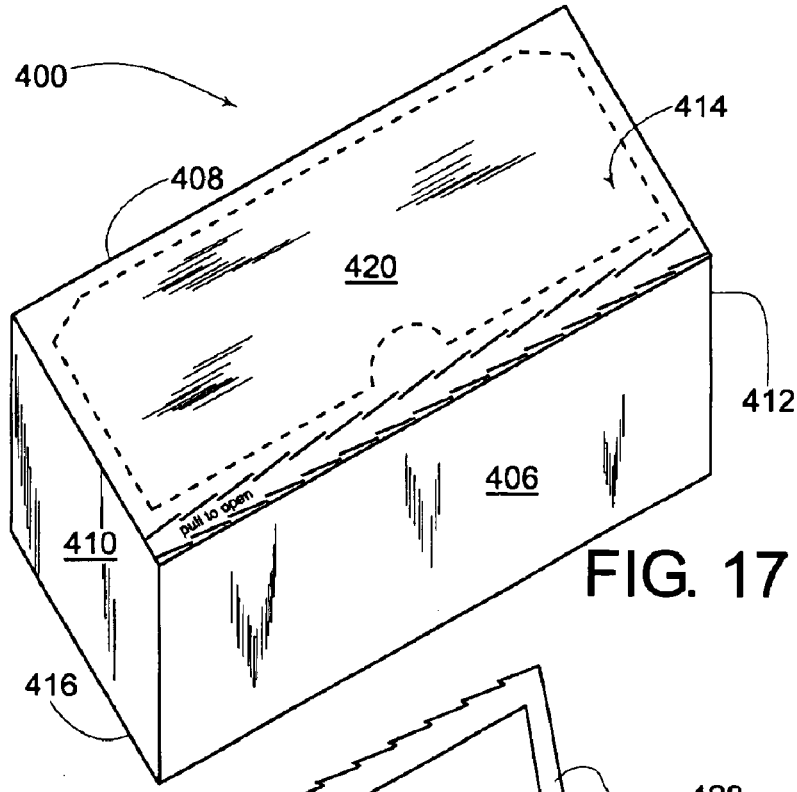
FIG. 17 shows a perspective view of a container.
Figure 18:
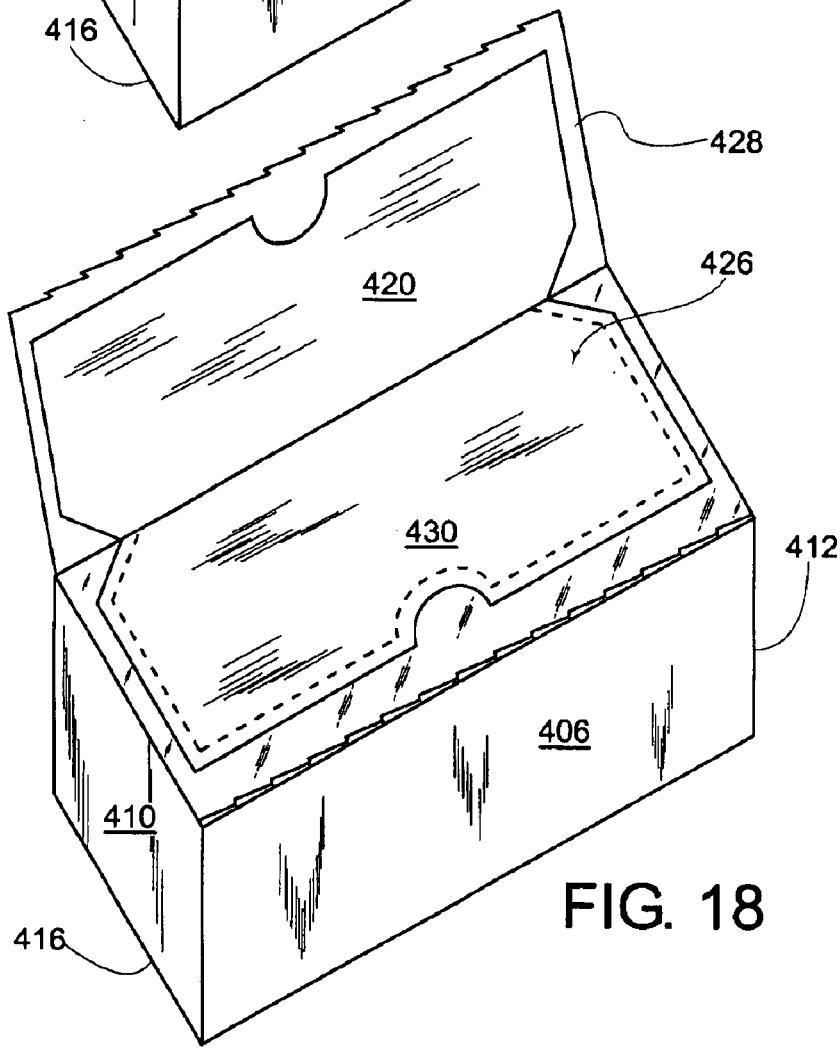
FIG. 18 shows a perspective view of the container of FIG. 17 in a first condition.
Figure 19:
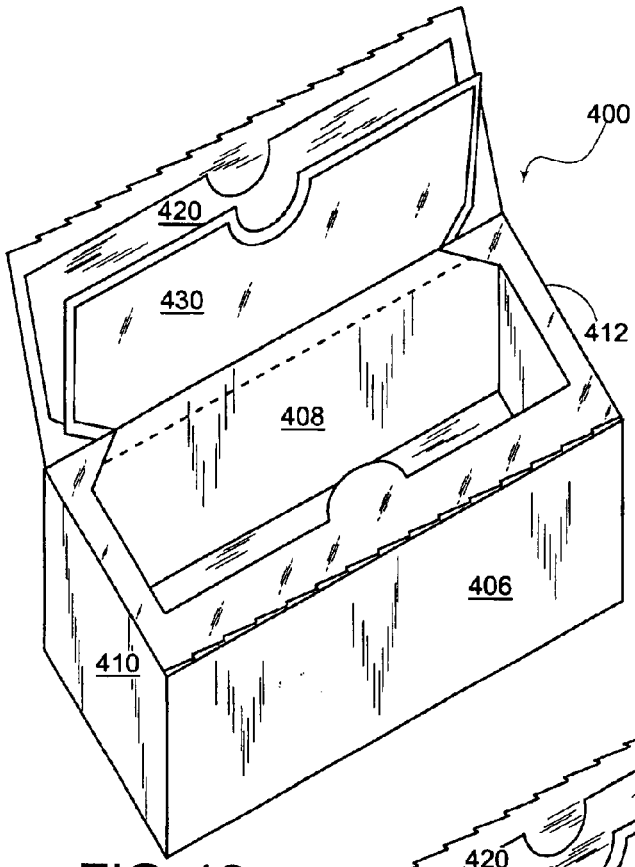
FIG. 19 shows a perspective view of the container of FIG. 17 in another condition.

Alternative configurations of the present apparatus have been contemplated. One example of these alternative embodiments is shown in FIGS. 17–19. With reference to FIG. 17, a container 400 may be provided with a front portion 406, a back portion 408, a first sidewall portion 410, a second sidewall portion 412, a top portion 414 and a bottom portion 416. The top portion 406 may be provided with a first access panel 420 and any one of a variety of opening initiators, such as a tear strip 422. With reference to FIG. 18, the container 400 may be further provided with an access assembly 426 having a first access panel support 428 and a second access panel 430. The access assembly 426 may be substantially similar to the access panel assembly 200, shown in FIG. 6. Furthermore, the access assembly 426 may be assembled in the container 400 in a manner similar to previously described with respect to container 100. The first access panel 420 may be opened in a manner similar to the first access panel 170 (FIG. 1). Additionally, as shown in FIG. 19, the second access panel 430 may be opened in a similar manner as the inner layer carrier 220 (FIG. 10). Therefore, container 400 may be essentially the same configuration as container 100.

Figure 20:
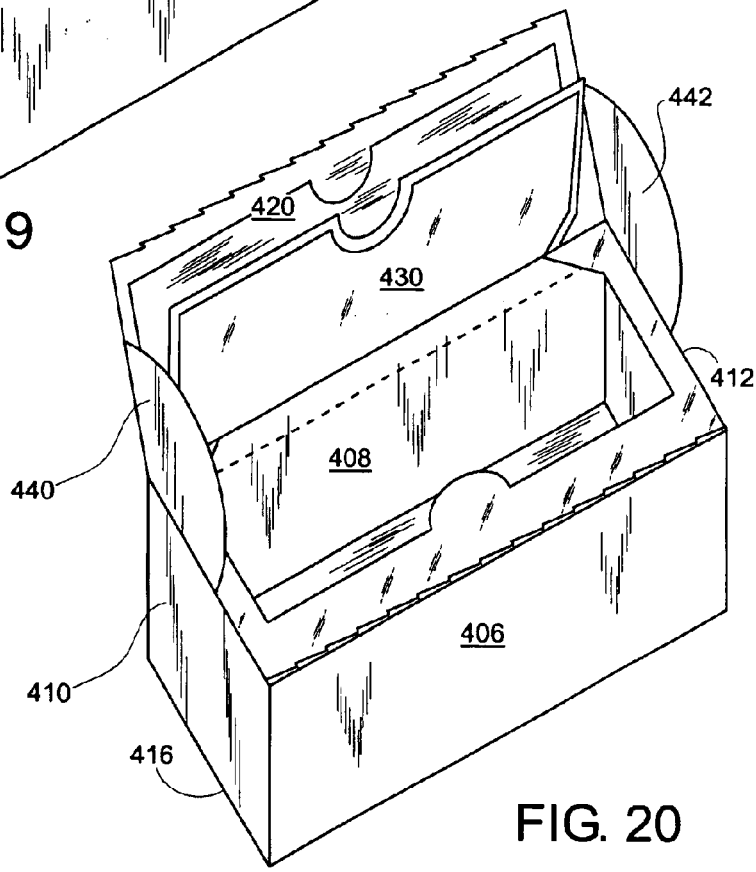
FIG. 20 shows a perspective view of the container of FIG. 17 provided with alternative elements.

In another alternative embodiment shown in FIG. 20, the container 400 may be provided with wings 440, 442. The wings 440, 442 limit the movement of the first access panel 420 in a manner substantially similar to the wings 240, 270 that may be provided with container 100.

Figure 21:
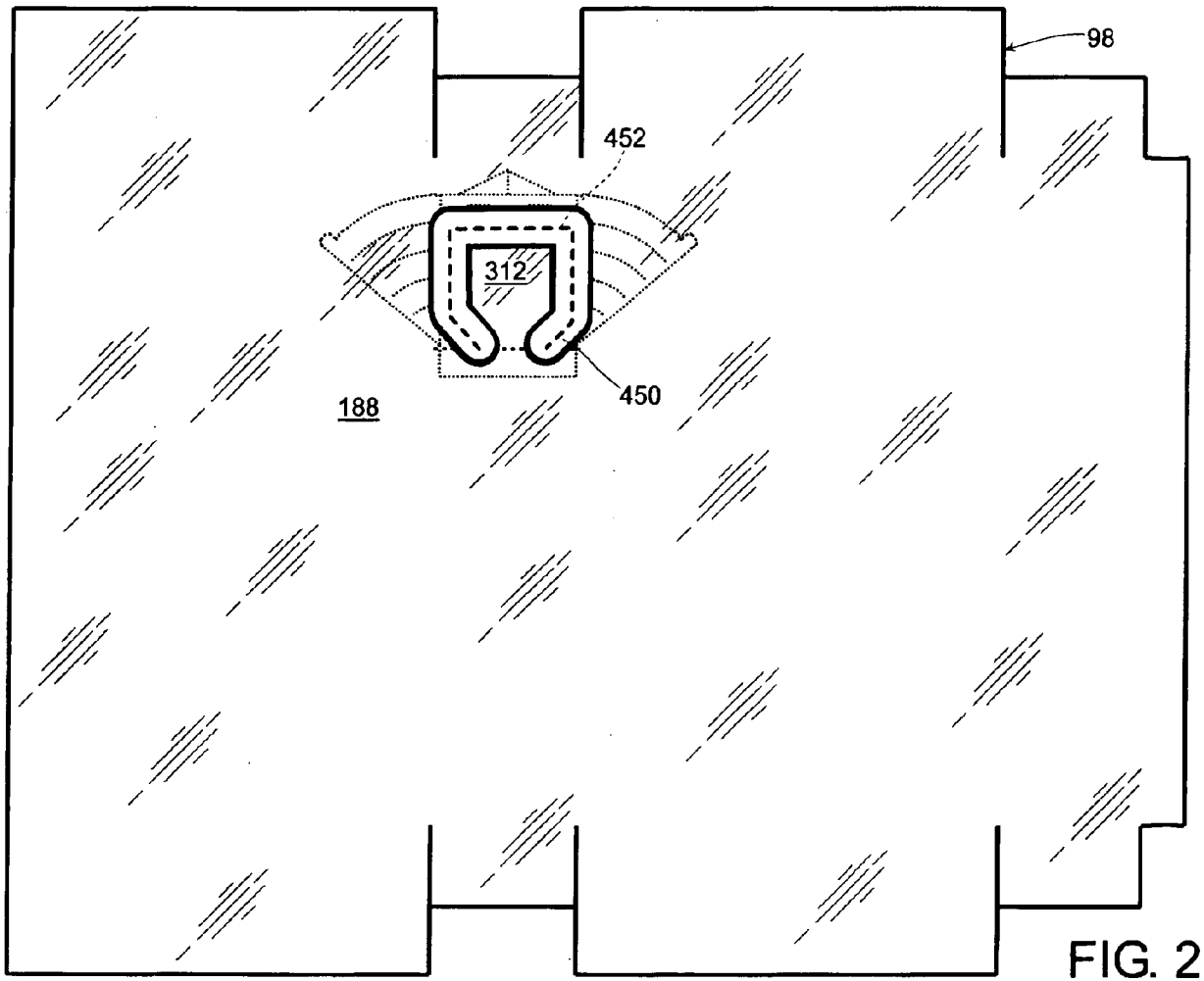
FIG. 21 shows a top plan view of a blank for a container.

In another alternative embodiment, shown in FIG. 21, the container 100 may be provided with a barrier patch 450 overlying a cut line 452. The barrier patch 450 and cut line 452 serve to provide a frangible portion to the inner layer 188. The manufacturing of such a configuration may occur in any one of a number of methods, such as pick-and-place operations while the blank 98 is in the web. This configuration with the barrier patch 450 and the cut line 452 allows for the inner layer carrier 220 to retain a portion of the inner layer 188 after separation of the attached portion 312 from the inner layer 188.

In another alternative embodiment shown in FIG. 22, the inner layer 188 may cover only a portion of the blank 98, for example it may extend over an area slightly larger than the adhesive-free portion 310. In this alternative shown in FIG. 22, the barrier between the container interior 102 and the container exterior 104 is the outer layer 180 (and not the inner layer 188, because it covers only a portion of the profile of the blank 98). In either case, the access panel assembly 200 may be captured between the inner layer 188 and the outer layer 180 and may have portions thereof adhesively attached to the container first sidewall portion 110 as previously described.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

We claim:

1. A container comprising:

an outer layer of a relatively rigid material;

an inner layer of a relatively flexible fluid impervious material, at least a portion thereof attached to said outer layer;

a first access panel defined by at least one fold line and a plurality of cut lines provided on said outer layer; and a second access panel located between said outer layer and said inner layer;

wherein at least a portion of said second access panel is attached to said inner layer;

wherein at least a portion of said second access panel is adjacent to at least a portion of said first panel; and a catch formed at least partially in said first access panel and said second access panel.

2. The container of claim 1 wherein:

said first access panel is hingedly attached to said outer layer.

3. The container of claim 1 wherein:

said second access panel is hingedly attached to said outer layer.

4. The container of claim 1 and further comprising:

a first wing hingedly attached to said first access panel; and a second wing hingedly attached to said first access panel.

5. The container of claim 1 and further comprising:

a frangible portion formed in said inner layer adjacent to said second access panel.

6. The container of claim 1 wherein:

said inner layer is frangibly attached to said second access panel.

7. The container of claim 1 wherein:

said inner layer comprises plastic.

8. The container of claim 1 wherein:

said outer layer comprises paperboard.

9. The container of claim 5 wherein:

said first wing and said second wing are located between said inner layer and said outer layer and are slidable relative to said inner layer and said outer layer.

10. The container of claim 1 wherein:

said catch comprises a tab and a recess.

11. The container of claim 10 and further comprising:

a wing hingedly attached to said first access panel;

wherein said tab is formed in said second access panel, and wherein said recess is formed in said wing.

12. The container of claim 1 wherein said second access panel further comprises:

a relatively rigid material layer; and a heat bondable layer formed parallel to said relatively rigid material layer.

13. The container of claim 12 wherein said second access panel further comprises:

a heat barrier layer formed between said second access panel relatively rigid material layer and said second access panel heat bondable layer.

14. The container of claim 12 wherein:

said second access panel relatively rigid material layer comprises paperboard.

15. The container of claim 13 wherein:

said second access panel heat barrier layer comprises metal.

16. A method of dispensing a product from a container defining an interior portion and an exterior portion, said method comprising:

pivoting a first access panel hingedly attached to said container about a first axis;

disrupting an inner layer, thereby exposing said interior portion to said exterior portion;

after said pivoting said first access panel, pivoting a second access panel hingedly attached to said container about a second axis, thereby creating an opening between said exterior portion and said interior portion; and dispensing said product from said container interior portion to said container exterior portion through said opening.

17. The method of claim 16 wherein:

said first axis is parallel to said second axis.

18. The method of claim 17 wherein:

said first axis is adjacent to said second axis.

19. A container defining an interior portion and an exterior portion, said container comprising:

a first container panel comprising an inside and an outside;

a first access panel hingedly attached to said first container panel about a first axis;

a second access panel hingedly attached to said first container panel about a second axis, wherein said second axis is substantially parallel to said first axis;

a first operating condition wherein:

said first access panel and said second access panel are parallel to said first container panel;

a second operating condition wherein:

said first access panel is not parallel to said first container panel, and said second access panel is parallel to said first container panel, a third operating condition wherein:

said second access panel is not parallel to said first container panel, and said second access panel is parallel to said first access panel.

* * * * *